United States Patent [19]

Tano et al.

[11] Patent Number: 4,741,130

[45] Date of Patent: May 3, 1988

[54] METHOD AND APPARATUS FOR SANDBLASTING A WORKPIECE

[75] Inventors: Teruo Tano, Tokyo; Shuji Hamada, Yokohama, both of Japan

[73] Assignee: Niigata Engineering Co., Ltd., Tokyo, Japan

[21] Appl. No.: 893,039

[22] Filed: Aug. 1, 1986

[30] Foreign Application Priority Data

Aug. 6, 1985 [JP] Japan ..... 60-172712

[51] Int. Cl.[4] ..... B24C 1/04; B24C 3/22

[52] U.S. Cl. ..... 51/319; 51/421; 51/424; 51/426

[58] Field of Search ..... 51/5 R, 235, 310, 319, 51/320, 321, 410, 417, 419, 421, 424, 425, 426

[56] References Cited

U.S. PATENT DOCUMENTS

| | | | |
|---|---|---|---|
| 2,454,158 | 11/1948 | Gossard | 51/421 |
| 2,628,456 | 2/1953 | Berg | 51/424 |
| 3,192,677 | 7/1965 | Johnson et al. | 51/424 X |
| 3,436,785 | 4/1969 | Kantor | 51/410 X |
| 3,545,996 | 12/1970 | Duncan | 51/424 X |
| 3,685,208 | 8/1972 | Richter | 51/410 X |
| 3,903,526 | 9/1975 | Cotter | 51/439 X |

FOREIGN PATENT DOCUMENTS

| | | | |
|---|---|---|---|
| 918068 | 4/1982 | U.S.S.R. | 51/319 |

*Primary Examiner*—Robert P. Olszewski

*Attorney, Agent, or Firm*—Kane, Dalsimer, Sullivan, Kurucz, Levy, Eisele, and Richard

[57] ABSTRACT

A method and apparatus for sandblasting a workpiece. The workpiece is placed at a machining position. Air is sucked around the workpiece at the machining position in a first direction to produce air streams. During sucking, abrasive grains are blown against a face of the workpiece in a second direction for sandblasting the work, the second direction crossing the first direction at an angle $\theta$ smaller than 90°. Abrasive grains blown against peripheries of the workpiece are larger in velocity than abrasive grains blown against a central portion of the workpiece.

19 Claims, 5 Drawing Sheets

METHOD AND APPARATUS FOR SANDBLASTING A WORKPIECE

BACKGROUND OF THE INVENTION

The present invention relates to a method and apparatus for sandblasting a work and particularly but not exclusively relates to a method and apparatus for sandblasting the work for chamfering and deburring one face thereof which should not be sandblasted.

Conventionally, chamfering of the outer periphery Wa and inner periphery Wc of a relatively small work W as illustrated in FIG. 8 is manually carried out with a polishing film in a thread form. Alternatively, such a process is made by sandblasting in which abrasive grains consisting of a silica sand, chilled cast iron, etc are blown against a face to be processed of the work.

However, the manual chamfering is laborious and hence disadvantageous in efficiency. On the other hand, the conventional sandblasting should not be applied to works such as heads of the video tape recorder since the head face thereof, which should be damaged by abrasive grains as little as possible, undergoes sandblasting as well as the outer periphery Wa and the inner periphery Wc.

SUMMARY OF THE INVENTION

Accordingly, it is an object of the present invention to provide a method and apparatus for sandblasting a work, in which efficiency in machining is enhanced.

It is another object of the present invention to provide a method and apparatus for sandblasting a work, in which the number of abrasive grains which impinge upon portions of the work except its portion to be sandblasted is considerably reduced and thus the work is prevented from being unacceptably damaged.

With these and other objects in view, one aspect of the present invention is directed to a method for sandblasting a work. The work is placed at a machining position. Air is sucked around the work at the machining position in a first direction to produce air streams. During sucking abrasive grains are blown against a face of the work in a second direction for sandblasting the work, the second direction crossing the first direction at an angle $\theta$ smaller than 90°. Abrasive grains which are blown against peripheries of the work are larger in velocity than abrasive grains which are blown against a central portion of the work.

Preferably, the work is supported for allowing the work to move in the second direction and thus the face of the work is prevented from being damaged by the abrasive grains when an excessive impact is applied to it.

The work may be placed in a sealed chamber, which is preferably moved in a vertical direction to a first position where the work at the machining position undergoes the suction step and the abrasive grains blowing step in the sealed chamber. Further, the sealed chamber may be vertically moved to a second position where clean air is blown against the work at the machining position for removing abrasive grains and abraded particles both adhered to the work, while air is drawn from the sealed chamber for exhausting abrasive grains and abraded particles, blown with the clean air, to the outside of the sealed room. Thereafter, the sandblasted work may be taken out of the sealed chamber. With such a construction, sandblasting requires less floor space.

The hardness of the abrasive grains is preferably defined as follows:

$$H_w\text{-about } 150 \leqq H_g \leqq H_w$$

where $H_g$ represents a Knoop hardness of the abrasive grains and $H_w$ represents a Knoop hardness of the work. Abrasive grains having such a hardness make grinding of the work W in larger part by their impact energy and in smaller part by their frictional movements and hence damages to its portions which should not be sandblasted may be reduced.

The ratio of a velocity of the abrasive grains blown against the work over a velocity of the air sucked may be in the range of about 0.01 to about 100.

Another aspect of the present invention is directed to an apparatus for practicing the method above stated. The apparatus includes: a holding means for holding a work for sandblasting, the work having a central portion and a peripheral portion; a horizontally moving means for horizontally moving the holding means so that the work is positioned at a machining position; suction means for sucking air around the work in a first direction while the work is positioned at the machining position; and blowing means for blowing abrasive grains against the work in a second direction for blasting the work during the suction of the air, said second direction crossing the first direction at an angle $\theta$ smaller than 90°, whereby abrasive grains blown near the peripheral portion of the work are larger in velocity than abrasive grains blown near a central portion of the work.

BRIEF DESCRIPTION OF THE DRAWINGS

The invention will now be described by way of example with reference to the accompanying drawings in which.

DETAILED DESCRIPTION OF THE PREFERRED EMBODIMENT

Figure 1:
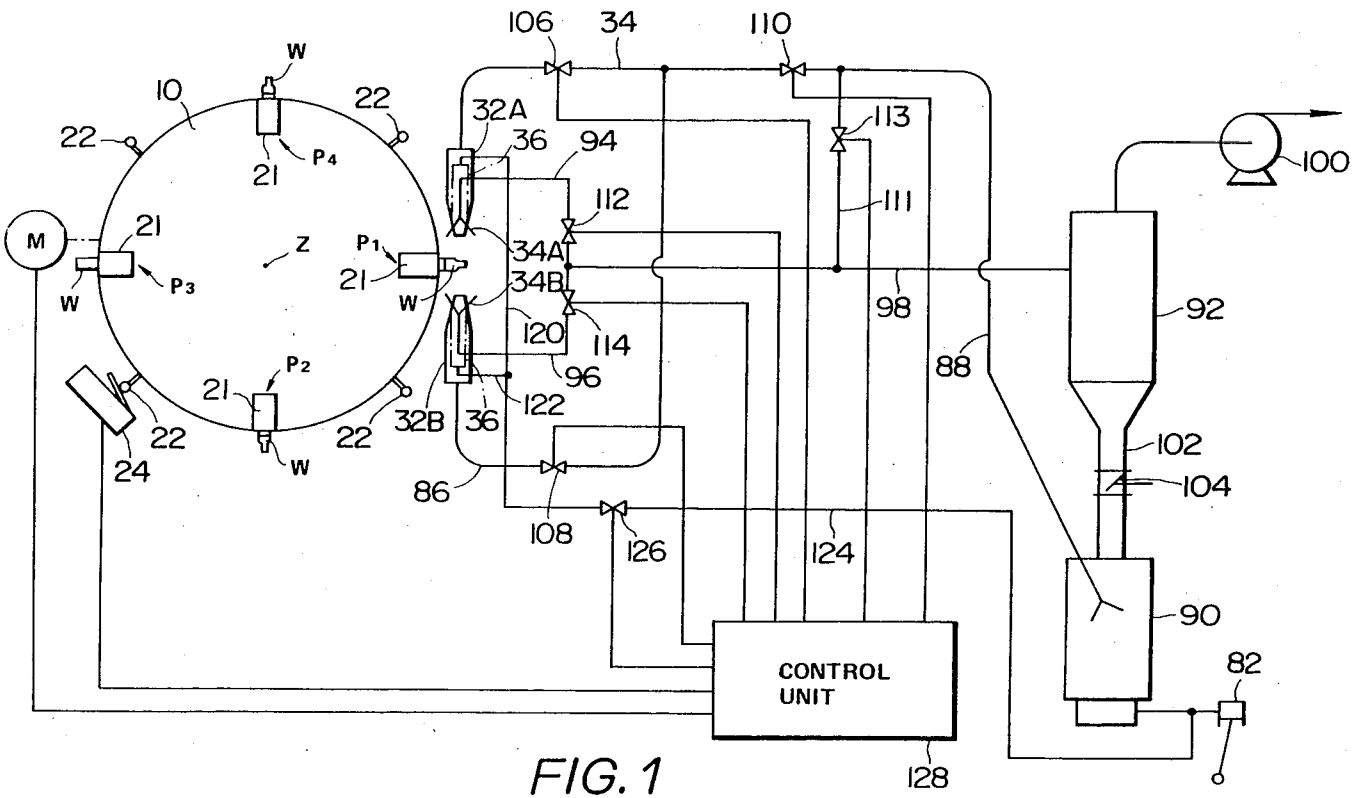
FIG. 1 is a diagrammatical view illustrating an sandblasting apparatus for practicing the present invention.
Figure 2:
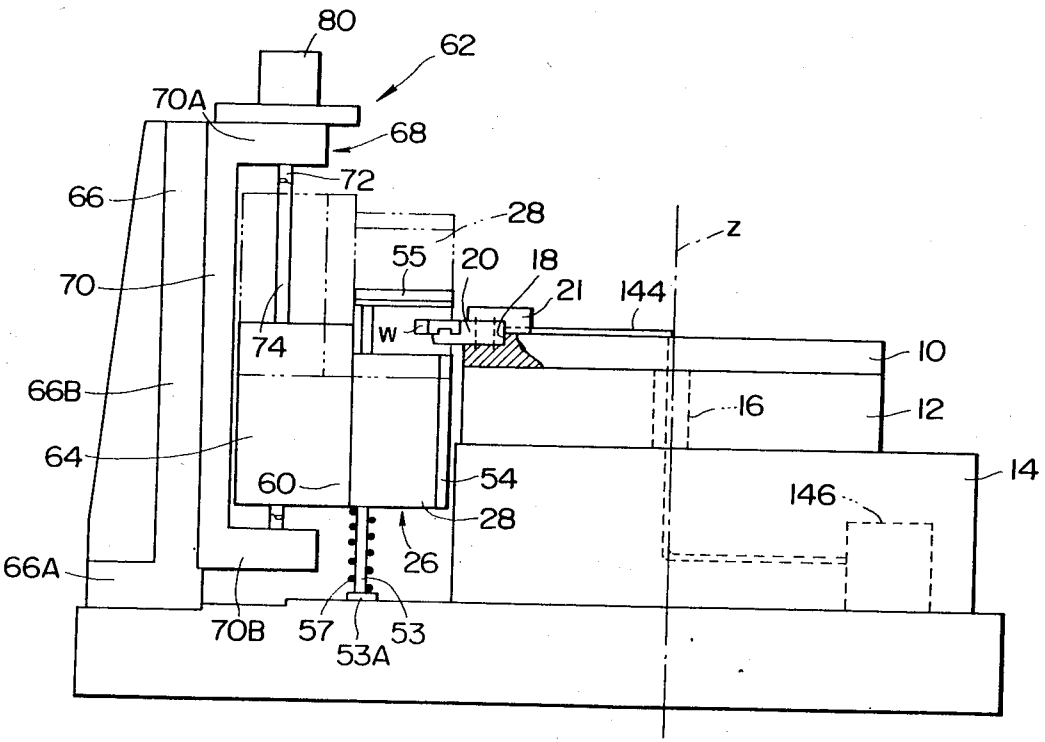
FIG. 2 is an enlarged side view of the apparatus in FIG. 1.
Figure 3:
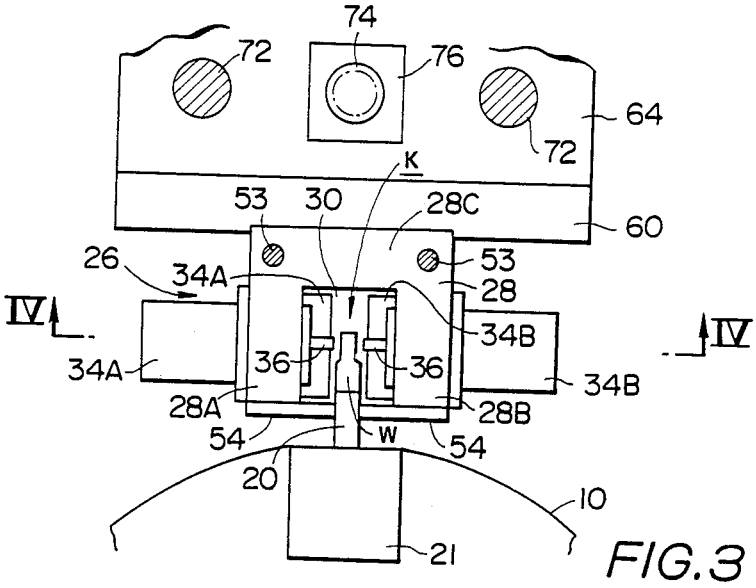
FIG. 3 is an enlarged plan view of the sandblasting unit and the work at the machining position in FIG. 2, in which upper sealing plates are removed for illustration purpose.
Figure 4:
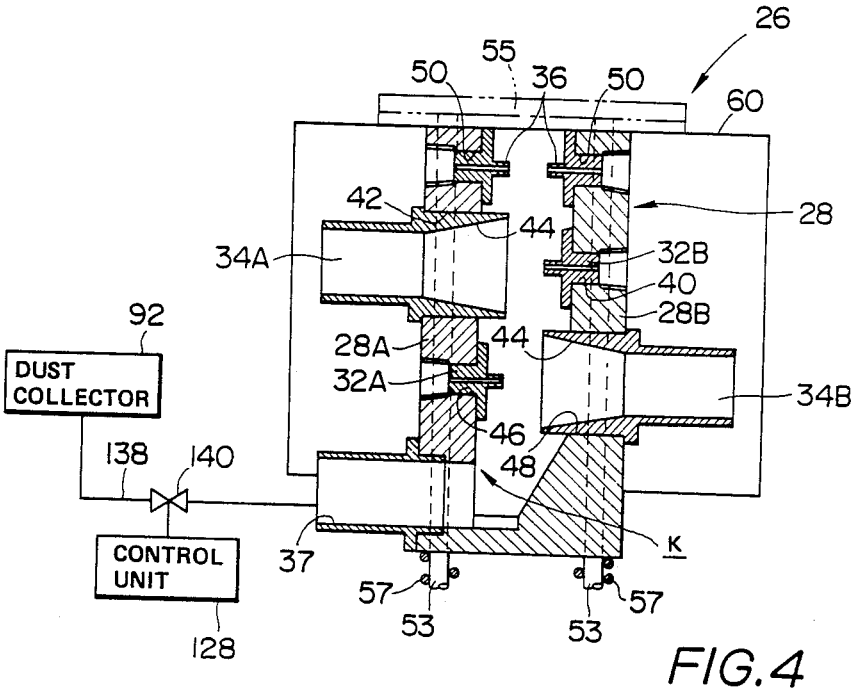
FIG. 4 is an enlarged vertical section taken along the line IV—IV in FIG. 3.

Referring to FIGS. 1 to 4, there is illustrated an apparatus, which is used for practicing the method according to the present invention, and in which the reference nuxeral 10 designates a rotary table which is mounted on a bed 12 to be rotatable about a vertical axis Z. The bed 12 is fixed on a base 14. The rotary table 10 is provided with a vertical shaft 16 about which it is rotated, and the vertical shaft 16 is operatively connected to an electric motor M through a conventional transmission unit not shown. The rotary table 10 has four recesses 18 forxed in its peripheral portions at equal angular intervals about the axis Z. Four work holders 20 are fitted in respective recesses 18 and their proximal portions are, as clearly shown in FIG. 2, covered and held with respective work holder fixers 21 which are fastened to the rotary table 10 through machine screws not shown. The work holders 20 have each a work W detachably attached to them. The rotary table 10 further has four actuating rods 22 mounted on its peripheral edge at equal angular intervals for actuating a limit switch 24. Each of the works W are intermittently fed to a machining position P1 by rotating the rotary table 10 and by detecting the position of the rotary table 10 with both the limit switch 24 and actuating rods 22. Adjacent to the machining position P1, a sandblasting unit 26 is provided and includes a channel-shaped frame member 28 having a closed bottom end 30. The frame member 28 has a pair of blasting nozzles 32A and 32B, a pair of suction nozzles 34A and 34B, opposed air injection nozzles 36 and 36 and an exhaust pipe 37, these nozzles and pipe being mounted on it. Front ends of the nozzles 32A, 32B, 34A, 34B, 36 and 36 are adapted to face the work W positioned at the machining position P1. The blasting nozzles 32A and 32B serve to blow abrasive grains, which have been carried with compressed air from an air compressor 82, against corresponding surfaces of the work W. The suction nozzles 34A and 34B serve to suck air around the work W for sucking abrasive grains and dust produced by the abrasive grains from the work W. A first set of the blasting nozzle 32B and the suction nozzle 34A are opposingly mounted at flanges 28A and 28B of the frame member 28. That is, one flange 28B has a blasting nozzle supporting hole 40 formed through it and a proximal portion of the blasting nozzle 32B is fitted into the hole 40. On the other hand, the other flange 28A has a suction nozzle supporting hole 42 formed through it to be concentric with the blasting nozzle supporting hole 40 and a front portion of the suction nozzle 34A is fitted into the suction nozzle supporting hole 42, thus the suction nozzle 34A being concentrically aligned with the blasting nozzle 32B. The suction nozzle 34A has a frustoconical suction wall 44 formed at its front portion to diverge toward the front thereof. The blasting nozzle 32A and the suction nozzle 34B which form a second set are the same in shape as the first set of the blasting nozzle 32B and the suction nozzle 34A, respectively and fitted into supporting holes 46 and 48 forxed through the flanges 28A and 28B just below the first set in the same manner as the latter. However, in the second set, the blasting nozzle 32A is fixed to the flange 28A and the suction nozzle 34B is fixed to the flange 28B. Further, each of the flanges 28A and 28B has an air blowing supporting hole 50 concentrically formed through an upper end portion thereof and an air blowing nozzle 36 is fitted into each supporting hole 50 to face to each other. The air blowing nozzles 36 and 36 serve to remove abrasive grains from faces of the work W by blowing clean air against the faces. The frame member 28 has a pair of parallel sliding rods 53 and 53 passing vertically and slidably through its web 28C as illustrated in FIG. 3. The sliding rods 53 and 53 have an equal length and are jointed at their upper ends by a horizontal rectangular rigid base plate 55 and at their lower ends by a horizontal sole plate 53A. The sliding rods 53 further have each a compression coil spring 57 extended around them between the frame member 28 and the sole plate 53A for spring biasing the latter downwards. The base plate 55 has a sealing plate bonded on its lower face for sealingly closing the upper opening of the channel-shaped frame member 28. The frame member 28 is further provided with a pair of second opposing rectangular sealing plates 54 and 54 (FIGS. 2 & 3) which are bonded to the front edges of the flanges 28A and 28B to abut at their vertical opposing edges against each other and thereby the front opening of the frame member 28 is closed. In this embodiment, the sealing members 54 and 54 are made of a closed-cell type sponge rubber but other conventional resilient sealing material may be used. With such a construction, a sealed machining room K is provided within the frame member 28.

The frame member 28 is secured at the rear face of its web 28C to an attachment plate 60, which is fixed to a slider 64 of a sliding unit 62 (FIG. 2). The sliding unit 62 includes a substantially angular-shaped supporting wall member 66, which is mounted at its shorter leg 66A on the base 14, and a guide 68 mounted on the supporting wall member 66. The guide 68 includes a channel-shaped bracket member 70 mounted on the vertical longer leg 66B of the supporting wall member 66 so that its flanges 70A and 70B are horizontal. The flanges 70A and 70B of the bracket member 70 have a ball screw 74 and a pair of guide rods 72 and 72 which extend parallel with and aligned to the ball screw 74. The ball screw 74 is rotatably supported at their opposite ends on the flanges 70A and 70B. The ball screw 74 loosely passes through the slider 64. A nut 76, which is secured to the slider 64, threadedly engages with the ball screw 74 with the channel of the frame member 28 being vertically directed. The guide rods 72 and 72 slidably pass through the slider 64 and mounted at their opposite ends to the flanges 70A and 70B. The ball screw 74 is connected at the upper end thereof to the output shaft (not shown) of a pulse motor 80 which is mounted on the upper flange 70A. Thus, the slider 64 is vertically moved by energizing the pulse motor 80 and thereby the two blowing nozzles 36 and 36, the opposing blasting nozzle 32B and suction nozzle 34A and the opposing blasting nozzle 32A and suction nozzle 34B are selectively positioned to a position to face the work W located at the machining position P1.

As shown in FIG. 1, the blasting nozzles 32A and 32B are communicated to an air compressor 82 through pipes 84, 86, 88 and a tank 90. The suction nozzles 34A and 34B are communicated to a dust collector 92 through pipes 94, 96 and 98. The dust collector 92 serves to produce air flow around the work W positioned at the machining position P1 with the suction nozzles 34A and 34B to thereby suck abrasive grains, which has ground the work, and dust produced. Thus abrasive grains and the dust sucked are separated from air in the dust collector 92 and then cleaned air is discharged by a blower 100 to the atmosphere. The dust collector 92 is communicated through a connecting duct 102 having a damper or butterfly valve 104 to the tank 90 and abrasive grains recovered are hence returned back through the connecting duct 102 to the tank 90. The pipes 84, 86, 88, 94 and 96 are provided with solenoid valves 106, 108, 110, 112 and 114, respectively. The pipes 88 and 98 are communicated through a bypass pipe 111 having a solenoid valve 113. The air blowing nozzles 36 and 36 which are shown by the phantom lines in FIG. 1 for illustration purpose are communicated through pipes 120, 122 and 124 to the air compressor 82, the pipe 124 having a solenoid valve 126. These valves 106, 108, 110, 112, 113, 114 and 126 are electrically connected to a conventional electric control unit 128.

Figure 6:
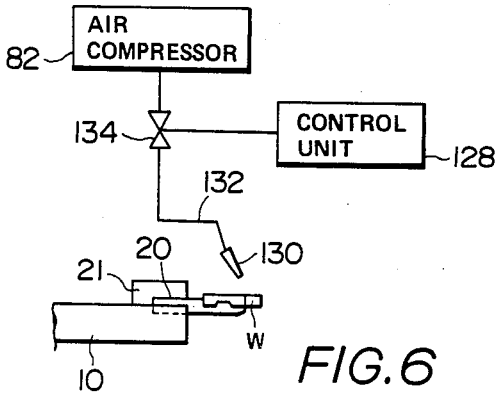
FIG. 6 is an illustration of an additional clean air blowing nozzle for preventing abrasive grains from impinging upon the upper face of the work W during sand blasting.
Figure 8:
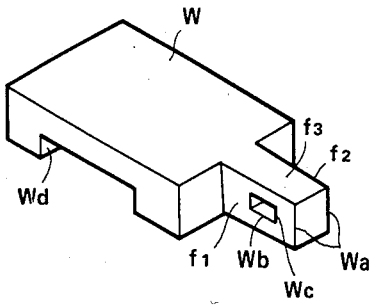
FIG. 8 is an enlarged perspective view of the work in FIG. 1.

When the work W is for a head of a video recorder or a like component, the upper face $f_3$ thereof must be mirror ground (FIG. 8). For the work W of this use, another clean air blowing nozzle 130 may be, as shown in FIG. 6, provided for preventing abrasive grains from impinging upon the upper face $f_3$ of the work W during sand blasting. The blowing nozzle 130 is connected to a pipe 132 so that it is directed to the face $f_3$ of the work W. The pipe 132 is mounted on the base 14 near the sliding unit 62 and is communicated through a solenoid valve 134 to the air compressor 82. The pipe 132 may be mounted on the flange 70A of the supporting wall member 66. The solenoid valve 134 is connected to the control unit 128. The pair of the sealing plates 54 and 54 allow the blowing nozzle 130 and the work W to go through their abutting edges into and out from the working room K.

The frame member 28 is provided at a bottom portion of its one flange 28A with an exhaust pipe 37 to communicate to the working room K. A negative pressure is produced in the working room K by evacuating air from it through the exhaust pipe 37 during operation of the air blowing nozzles 36 and 36, thus preventing abrasive grains and dust from going outside the working chamber K. The exhaust pipe 37 is communicated via a pipe 138 having a solenoid valve 140 to the dust collector 92, the valve 140 being also connected to the control unit 128.

Figure 5:
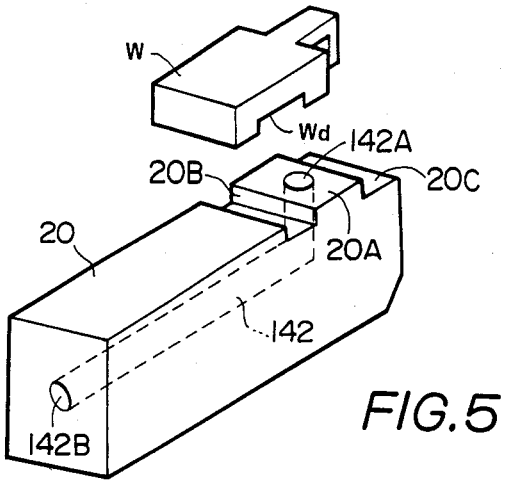
FIG. 5 is an enlarged exploded view of the work and the work holder in FIG. 2.

As best shown in FIG. 5, each work holder 20 has a substantially rectangular prism shape and is provided in its upper face with a ridge 20A which is defined by forming a groove 20B and cutout 20C in the upper face. An exhaust passage 142 opens at one end 142A to the upper face of the ridge 20A and passes through the work holder 20 to open at the other end 142B to the proximal end of the work holder 20. The other end 142B is connected via a pipe 144 having a solenoid valve (not shown) to a vacuum pump 146 (FIG. 2). Also, this solenoid valve is connected to the control unit 128. As illustrated in FIG. 5, each work W is provided in its lower end with a groove Wd. Each of the work W is designed to ride on the work holder 20 by engaging the ridge 20A with the groove Wd. The work W is held on the work holder 20 by evacuating the passage 142 and thus the work W is allowed to slide along the ridge 20A in the direction of blasting of abrasive grains from the blasting nozzles 32A and 32B when abrasive grains excessively strongly impinge upon the face $f_1$ or $f_2$ of the work W, so that impact against the faces is reduced. This ridge and groove engagement of the work W to the work holder 20 further prevents change in direction of the faces $f_1$ and $f_2$ relative to the blasting nozzles 32A and 32B when abrasive grains apply torque to the work W.

Figure 7:
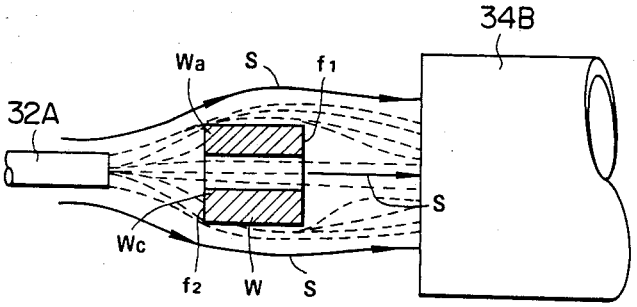
FIG. 7 is an illustration of sandblasting with a set of the blowing nozzle and the suction nozzle.

In operation, the air compressors 82, dust collector 92 and blower 100 are actuated in advance. A work W is successively fitted to the work holder 20 at a position P4 and is fed to the working position $P_1$ by intermittently turning the rotary table 1. In this event, the slider 64 is located at the lowermost position shown by the solid line in FIG. 2 so that the frame member 28 may not impinge upon the work W. When each work W arrives at the position $P_1$, this is detected by actuating the limit switch 24 with actuating rod 22, causing the electric motor M to stop through the control unit 128. Thus, the work W is located at the working position $P_1$ and then the control unit 128 provides predetermined electric signals to the pulse motor 80 to energize the latter for elevating the slider 64. Thus, the distal end of the work holder 20 and the work W pass between the abutting edges of the flexible sealing plates 52 and 52, proceed between the abutting edges of the sealing plates 54 and 54 and then enter the working chamber K. When the faces $f_1$ and $f_2$ of the work W are positioned between the nozzles 36 and 36, the sealing member of the base plate 55 contacts the upper ends of the frame member 28 by a force exerted by the coil springs 57 and 57 and closes the upper opening of the frame member 28, thus forming a sealed working chamber K. When the faces $f_1$ and $f_2$ of the work W are positioned between the blasting nozzle 32A and the suction nozzle 34B, the pulse motor 80 is deenergized, thus stopping slider 64 at a position shown by the phantom line in FIG. 2. After this, the working chamber K is evacuated by opening the valve 114, with the result that air streams S are, as illustrated in FIG. 7, produced from the blasting nozzle 32A to the suction nozzle 34B. Then, the valves 106 and 110 are opened and the valve 113 is closed by the control unit 128, so that abrasive grains, which have been circulated in a passage consisting of tank 90, pipes 88, 111 and 98 and dust collector 92, are fed via pipes 88 and 84 to the blasting nozzle 32A. Thus, the abrasive grains are blown against one face $f_2$ of the work W. In this event the abrasive grains are largely affected by the air streams S. The amount of abrasive grains which impinge upon the inner periphery Wc and the outer periphery Wa of the face $f_2$ which are to be chamfered largely increases since there is a tendency of the grains being directed toward the inner and outer peripheries due to the air streams. In addition the abrasive grains impinge upon the inner periphery Wc and the outer periphery Wa in an accelerated manner since air streams near the inner and outer peripheries are relatively high in speed. These result in a large increase in efficiency of grinding. On the other hand, the amount of abrasive grains which impinge perpendicularly against the face $f_2$ which is to be protected from abrasive grains fairly reduces and hence the degree of damage to the face $f_2$ is considerably reduced. In the absence of the air streams S, a large part of the blasted abrasive grains impinges substantially perpendicularly upon the face $f_2$ of the work W. After grinding, the abrasive grains are sucked by the suction nozzle 34B and then carried through pipe 96, 98 into the dust collector 92.

When the processing of the face $f_2$ is completed, the valves 106 and 114 are closed and the valve 112 is opened and then the pulse motor 80 is again energized by the control unit 128 to lower the slider 64 so that the work W is positioned between the blasting nozzle 32B and the suction nozzle 34A in an arrangement similar to the arrangement in FIG. 7 although the blasting nozzle 32B is located on the right side of the work W and the suction nozzle 34A on the left side in FIG. 7. Then, the face $f_1$ is chamfered at its inner and outer peripheries Wc and Wa in a manner similar to the manner in the face $f_2$.

After the grinding of the face $f_1$, the slider 64 is further lowered so that the work W is positioned between the air blowing nozzles 36 and 36. Then, the valve 126 is opened for supplying clean air from the air compressor 82 to the blowing nozzles 36 and 36, so that the clean air is injected from the blowing nozzles 36 and 36 against the faces $f_1$ and $f_2$ of the work W for removing abrasive grains and abraded particles adhered to the faces. On the other hand, the valve 140 (FIG. 4) is opened for sucking the removed grains and particles through the exhaust pipe 37 and for carrying them through the pipe 138 into the dust collector 92.

In the operation above stated, the flow rate of the exhaust air in each of the suction nozzles 34A and 34B and the exhaust pipe 37 is set to be always larger than the flow rate of the air and abrasive mixture in each of blasting nozzles 32A and 32B and the air blowing nozzle 36, with the result that negative pressure is applied in the machining chamber K. Thus, the sealing plates 54, 54 and 55 are attracted inside and degree of sealing thereof is thereby enhanced and there is hence little possibility of abrasive grains and abraded particles going from the machining chamber K to the atmosphere. The ratio of the velocity of abrasive grains blown against the work over a velocity of streams S is preferably in the range of about 0.01 to about 100.

When the chamfering and cleaning of the work W are completed, the pulse motor 80 is energized for lowering and returning the slider 64 against the spring force, exerted by the coil springs 57 and 57, to the original position shown by the solid line in FIG. 2, at which position the sole plate 53A is urged against the base 14 by the coil springs 57 and 57. Then the processed work W is moved by intermittently rotating the rotary table 10 to a position P3 where it is removed from the work holder 20. The operations above stated are successively repeated.

Although there is no specific limitation in the kind and hardness of abrasive grains used in the present invention, it is preferable to use abrasive grains being smaller in hardness than the work W since such abrasive grains make grinding of the work W in larger part by their impact energy and in smaller part by their frictional movement. In this case, the hardness of abrasive grains used is defined as follows:

$$H_w\text{-about } 150 \leqq H_g \leqq H_w$$

where $H_g$ represents a Knoop hardness of the abrasive grains and $H_w$ represents a Knoop hardness of the work.

Figure 9:
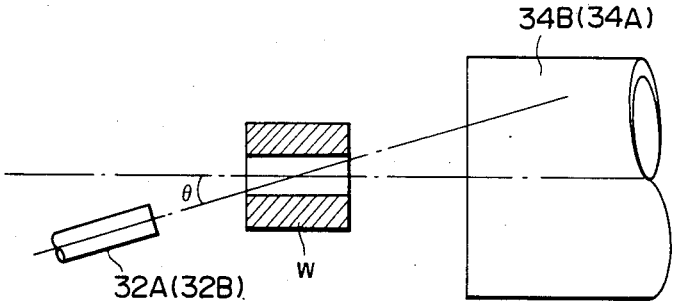
FIG. 9 is an illustration of sandblasting with a set of the blowing nozzle and the suction nozzle with their axes crossing at an angle $\theta$.

In the embodiment above stated, blasting nozzles 32A, 32B and suction nozzles 34A and 34B are used in sets, but the ratio in number of the blasting nozzles over the suction nozzles which are used in combination for processing one face of the work W is not limited to one. For example, two blasting nozzles may be used for a single suction nozzle or one blasting nozzle may be used for two suction nozzles. As shown in FIG. 9, the suction nozzles 34A, 34B may be disposed at an angle $\theta$ to the direction of the blasting nozzles 32A, 32B, respectively, instead of the coaxial alignment as illustrated in the embodiment, wherein the angle $\theta$ is not larger than 90°. Further, an additional suction nozzle may be disposed perpendicularly to each set of the blasting nozzle 32A, 32B and the suction nozzle 34A, 34B.

As an alternative mounting means of the work W in an impact absorbing manner, resilient devices including such as a spring may be used in place of vacuum attraction of the work W to the work holder 20. Further, the work holder 20 may be mounted to the rotary table 10 through such impact absorbing devices.

The present invention may be applied for sandblasting part of a face of a work rather than chamfering the work.

What is claimed is:

1. A method of sandblasting a workpiece having a face, comprising the steps of:

(a) placing the workpiece at a machining position;

(b) sucking air around the workpiece at the machining position in a first direction to produce air streams; and (c) during the suction step (b), blowing abrasive grains against the face of the workpiece in a second direction for sandblasting the workpiece, said second direction crossing the first direction at an angle $\theta$ smaller than 90°, whereby abrasive grains blown against peripheries of the workpiece are larger in velocity than abrasive grains blown against a central portion of the workpiece for reducing damage to the central portion of the workpiece due to the blown abrasive grains and for sandblasting the peripheries of the face.

2. A method as recited in claim 1, further comprising the step of supporting the workpiece for allowing the workpiece to move in the second direction to prevent the face of the workpiece from being damaged by the abrasive grains.

3. A method as recited in claim 1 or 2, further comprising the steps of:

placing the workpiece at the machining position within a sealed chamber before the steps (b) and (c);

after the steps (b) and (c), blowing a clean air against the sandblasted workpiece within the sealed chamber for removing abrasive grains and abraded particles both adhered to the workpiece;

during the clean air blowing step, drawing air from the sealed chamber for exhausting the abrasive grains and abraded particles, blown with the clean air, to the outside of the sealed chamber; and then, taking the sandblasted workpiece outside the sealed chamber.

4. A method as recited in claim 3, further comprising the steps of:

vertically moving the sealed chamber to a first position where the workpiece at the machining position undergoes the suction step (b) and the abrasive grains blowing step (c) in the sealed chamber;

further vertically moving the sealed chamber to a second position where the workpiece at the machining position undergoes the clean air blowing step; and then vertically moving the sealed chamber to a third position where the workpiece is placed on the outside of the sealed chamber.

5. A method as recited in claim 4, wherein the hardness of the abrasive grains is defined as follows:

$$H_w\text{-about } 150 \leqq H_g \leqq H_w$$

where $H_g$ represents a Knoop hardness of the abrasive grains and $H_w$ represents a Knoop hardness of the workpiece.

6. A method as recited in claim 5, wherein the ratio of a velocity of abrasive grains blown against the workpiece over a velocity of the air sucked during the steps (a) and (b) is in the range of about 0.01 to about 100.

7. An apparatus for practicing the method as recited in claim 1, comprising:

holding means for holding a workpiece for sandblasting, said workpiece having a central portion and a peripheral portion;

horizontally moving means for horizontally moving the holding means so that the workpiece is positioned at a machining position;

suction means for sucking air around the workpiece in a first direction while the workpiece is positioned at the machining position; and blowing means for blowing abrasive grains against the workpiece in a second direction for blasting the workpiece during the suction of the air, said second direction crossing the first direction at an angle $\theta$ smaller than 90°, so that the abrasive grains blown against the peripheral portion of the workpiece are larger in velocity than abrasive grains blown against the central portion of the workpiece for reducing the damage to the central portion due to the blown abrasive grains and for sandblasting the peripheral portion of the workpiece.

8. An apparatus as recited in claim 7, wherein said holding means comprises sliding means for sliding the workpiece in the second direction and retaining means for retaining the work in position in a manner such that the workpiece is allowed to move in the second direction when the workpiece is subjected to an impact from abrasive grains to such a degree that the workpiece may be damaged.

9. An apparatus as recited in claim 8, wherein said retaining means comprises attracting means for attracting the workpiece in position by producing a vacuum.

10. An apparatus as recited in claim 7, 8 or 9 further comprising:

means for receiving the workpiece at said machining position in a sealed manner and for supporting the suction means and the blowing means so that the workpiece is sandblasted therein; and vertically moving means for vertically moving the receiving means so that the receiving means may receive therein the workpiece at the machining position.

11. An apparatus as recited in claim 10, wherein said vertically moving means is adapted to move the receiving means to a first position where the sandblasting is carried out by means of the blowing means and the suction means, then to a second position and a third position where the workpiece is located outside the receiving means, and further comprising: clean air blowing means mounted on the receiving means for blowing clean air against the workpiece at the second position for removing abrasive grains and abraded particles both adhered to the workpiece; and exhausting means mounted on the receiving means for exhausting abrasive grains and abraded particles, both blown with the clean air, to the outside of the receiving means.

12. A method of sandblasting a workpiece having a face formed of a peripheral portion and a remaining other portion and a rear portion behind the face, comprising the steps of:

(a) placing the workpiece at a machining position (b) sucking air around the work at the machining position from behind the face of the workpiece in a first direction to produce air streams; and (c) during the suction step (b), blowing abrasive grains against the face in a second direction for sandblasting the peripheral portion of the face, said second direction crossing the first direction at an angle $\theta$ smaller than 90° so that abrasive grains blown against the peripheral portion of the face of the workpiece are larger in velocity than abrasive grains blown against the other portion of the face of the workpiece for reducing damage to the other portion of the face due to the blown abrasive grains and for sandblasting the the peripheral portion of the face.

13. A method as recited in claim 12, further comprising the step of supporting the workpiece for allowing the workpiec to move in the second direction by an excessive impact of abrasive grains, blown against the face, to prevent the face from being damaged.

14. A method as recited in claim 12 or 13, further comprising the steps of:

placing the workpiece at the maching position within a sealed chamber before the steps (b) and (c);

after the steps (b) and (c), blowing a clean air against the sandblasted workpiece within the sealed chamber for removing abrasive grains and abraded particles both adhered to the workpiece;

during the clean air blowing step, drawing air from the sealed chamber for exhausting the abrasive grains and abraded particles, blown with the clean air, to the outside of the sealed chamber; and then, taking the sandblasted workpiece outside the sealed chamber.

15. A method as recited in claim 14, further comprising the steps of:

vertically moving the sealed chamber to a first position where the workpiece at the machining position undergoes the suction step (b) and the abrasive grains blowing step (c) in the sealed chamber;

further vertically moving the sealed chamber to a second position where the workpiece at the machining position undergoes the clean air blowing step; and then vertically moving the sealed chamber to a third position where the workpiece is placed on the outside of the sealed chamber.

16. A method as recited in claim 15, wherein the hardness of the abrasive grains is defined as follows:

$$H_w\text{-about } 150 \leqq H_g \leqq H_w$$

where $H_g$ represents a Knoop hardness of the abrasive grains and $H_w$ represents a Knoop hardness of the workpiece.

17. A method as recited in claim 16, wherein the ratio of a velocity of abrasive grains blown against the workpiece over a velocity of the air sucked during the steps (a) and (b) is in the range of about 0.01 to about 100.

18. An apparatus for practicing the method as recited in claim 12 comprising:

holding means for holding a workpiece for sandblasting, said workpiece having a face;

horizontally moving means for horizontally moving the holding means so that the workpiece is positioned at a machining position;

suction means for sucking air around the workpiece from behind the face in a first direction while the workpiece is positioned at the machining position; and blowing means for blowing abrasive grains against the face of the workpiece in a second direction during the suction of the air for sandblasting the the peripheral portion of the face, said second direction crossing the first direction at an angle $\theta$ smaller than 90°, so that the abrasive grains blown against the peripheral portion of the face of the workpiece are larger in velocity than abrasive grains blown against the other portion of the face for reducing damage to the other portion of the face due to the blown abrasive grains and for sandblasting the peripheral portion of the face.

19. An apparatus as recited in claim 18, wherein said holding means comprises sliding means for sliding the work in the second direction and retaining means for retaining the work in position in a manner such that the work is allowed to move in the second direction when the face of work is subjected to an impact from abrasive grains to such a degree that the work may be damaged.

* * * * *